US005636490A

United States Patent [19]

Stocksieker

[11] Patent Number: 5,636,490

[45] Date of Patent: Jun. 10, 1997

[54] ROOF SYSTEM

[76] Inventor: Richard Stocksieker, Dingle Hill Rd., Andes, N.Y. 13731

[21] Appl. No.: 623,180

[22] Filed: Mar. 28, 1996

[51] Int. Cl.[6] ..... E04D 1/00

[52] U.S. Cl. ..... 52/556; 52/531; 52/540

[58] Field of Search ..... 52/556, 540, 518, 52/530, 531, 748.1, 748.11, 57, 198

[56] References Cited

U.S. PATENT DOCUMENTS

| | | | |
|---|---|---|---|
| 1,365,800 | 1/1921 | Snyder | 52/518 |
| 1,723,076 | 8/1929 | Reynolds | 52/556 X |
| 1,963,583 | 6/1934 | Jenkins | 52/556 X |
| 2,081,191 | 5/1937 | Wright | 52/556 X |
| 2,151,794 | 3/1939 | Peebles | 108/10 |
| 2,164,712 | 7/1939 | Kirschbraun | 108/8 |
| 2,210,599 | 8/1940 | Percy, Jr. | 52/556 X |
| 2,384,686 | 9/1945 | Kraus | 20/5 |
| 2,592,482 | 4/1952 | Sperry | 52/531 |
| 2,672,831 | 3/1954 | Fink | 108/8 |
| 2,847,948 | 8/1958 | Truitt | 108/6 |
| 3,137,972 | 6/1964 | Ekholm et al. | 52/556 X |
| 3,164,929 | 1/1965 | Boddie | 52/531 X |
| 3,237,361 | 3/1966 | Norman, Jr. | 52/556 X |
| 3,485,004 | 12/1969 | Mattes | 52/556 X |
| 3,665,667 | 5/1972 | Oberley et al. | 52/566 |
| 3,815,310 | 6/1974 | Kessler | 52/531 |
| 4,079,561 | 3/1978 | Vallee | 52/530 X |
| 4,554,862 | 11/1985 | Wolfert | 52/556 X |
| 4,942,699 | 7/1990 | Spinelli | 52/57 |

*Primary Examiner*—Carl D. Friedman
*Assistant Examiner*—Aimee E. McTigue

[57] ABSTRACT

A roof system and the method of producing same using rolls of material to provide continuous tiers or rows of roof covering over wood panels avoiding vertical roof seams. Plastic is first placed over the wood panels and then a metal cover such as aluminum or copper is applied. The wood panels are affixed to the structure beneath both the plastic strip and the metal cover. Each tier overlaps the upper edge of next lower tier. At the peak of the roof, a cap is provided with abutting wood members secured to the structure covered by a plastic sheet and with a metal member over the plastic sheet.

3 Claims, 3 Drawing Sheets

Fig. 3
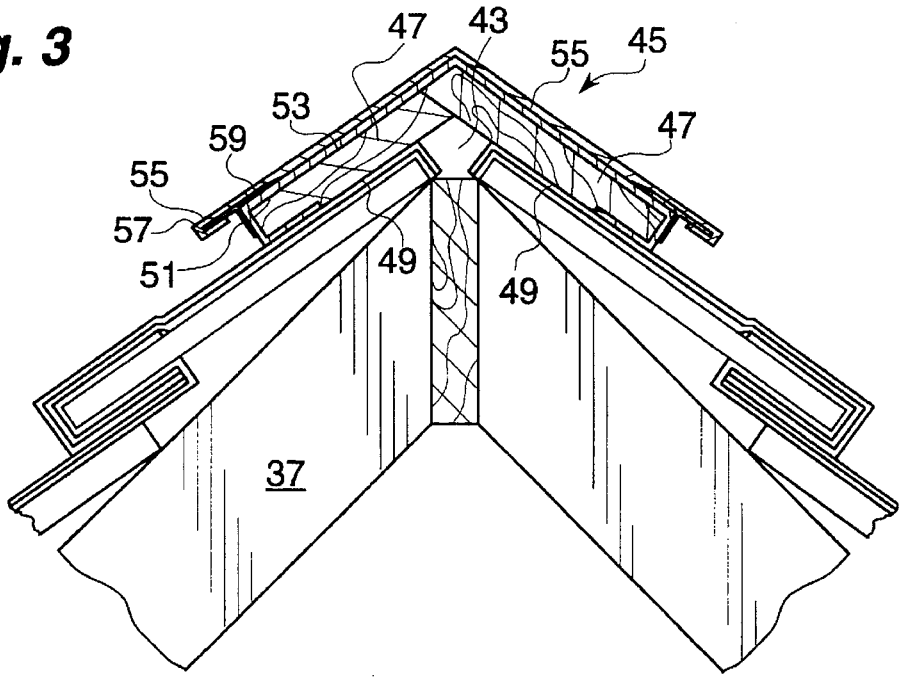
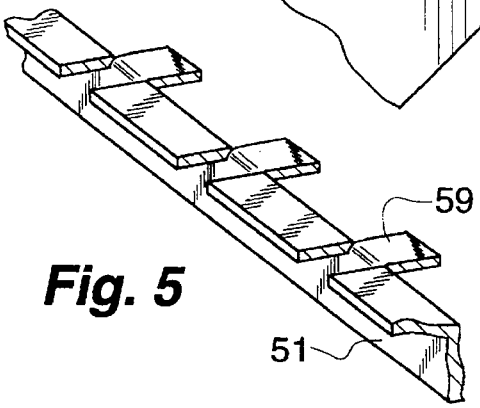
Fig. 5
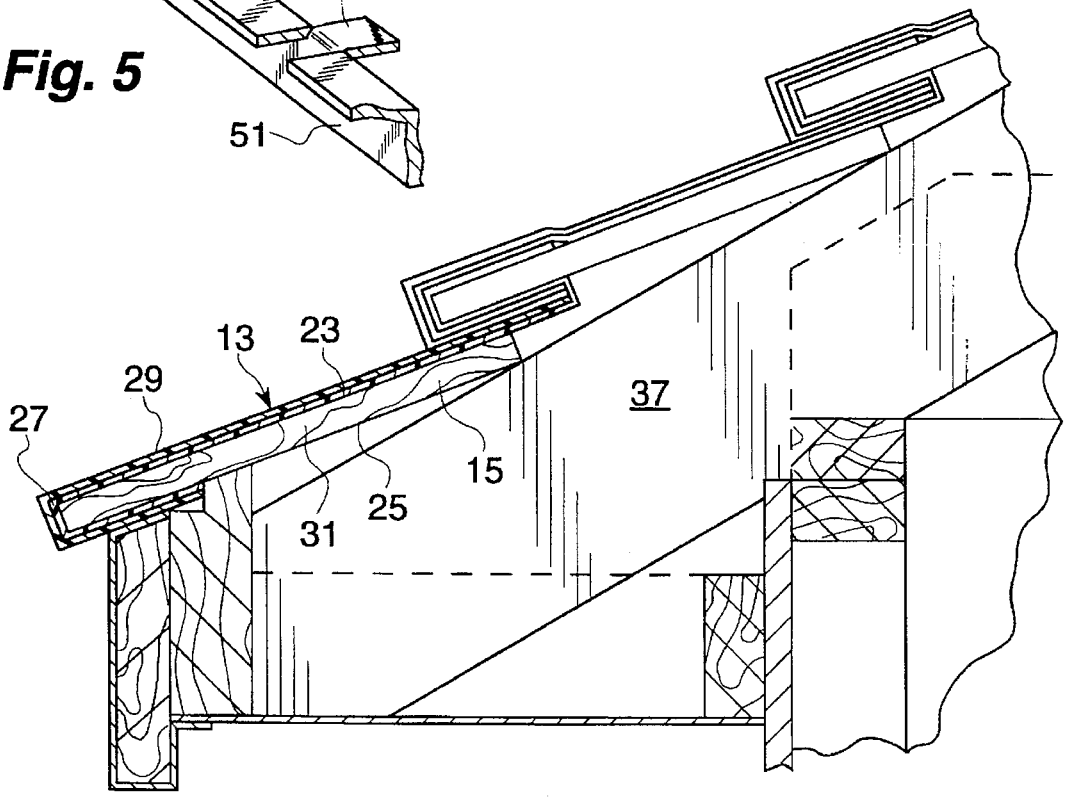
Fig. 4

ROOF SYSTEM

BACKGROUND OF THE INVENTION a wide variety of shingled roofs are well known. All such roofs have vertical seams and locate the next higher tier or row to cover the vertical seams of the adjacent lower tier. In this way, leaks are avoided at least for awhile. However, as the upper tier begins to deteriorate, leaks develop at the vertical seams. Metal roofs are traditionally very expensive to construct due to the skill and labor needed to seal the seams frequently requiring soldering of such seams.

This invention provides a metal covered roof without vertical seams which can be readily and inexpensively installed.

SUMMARY OF THE INVENTION

In accordance with the present invention, a roof design is provided with continuous horizontal tiers or rows. Each tier is overlapped by the next higher tier. Each tier is constructed on a series of horizontal panels of substantially the same width. Plastic strips cover the wood panels and metal covers the plastic. The metal and plastic preferably are provided in rolls and cut to length at the site depending upon the horizontal length of the roof being constructed. The wood panels are affixed beneath the plastic to the rafters of the structure and each higher row or tier of plywood overlaps the adjacent lower tier of row. A plastic strip is wrapped under the lower edge of the first row and folded up and over a substantial portion of the wood panels. A metal covering is also affixed under the lower edge of the first row over the plastic but covering less of the wood panels than the plastic strip so that the plastic extends beyond the metal forming an extended portion. The extended portion of the plastic strip is folded back over the metal cover. The next adjacent tier of wood is put in place with the lower edge of the second tier covering a small upper part of the metal covering. The extended portion of the plastic strip is folded over the lower edge of the second tier and plastic is the placed under the lower edge of the second tier and metal is similarly placed under the lower edge of the second tier and extended up over the plywood of the second tier as described for the initial tier. At the peak, a cap is constructed of two wood members with a continuous plastic sheet covered with a metal member. An angle member is affixed to the edges of the wood members. The edges of the metal member are bent over and affixed to the extended portion of the L-shaped member.

DESCRIPTION OF THE DRAWINGS

FIG. 3 is a cross-sectional view along line 3—3 of FIG. 1 showing the cap of the roof on the peak of the roof.

FIG. 4 is a cross-sectional view along line 4—4 of FIG. 1 showing the lowest tier of the roof.

FIG. 5 is a plan view of the I-shaped member used with the cap to affix the metal member to the cap.

DETAILED DESCRIPTION OF THE INVENTION

Figure 1:
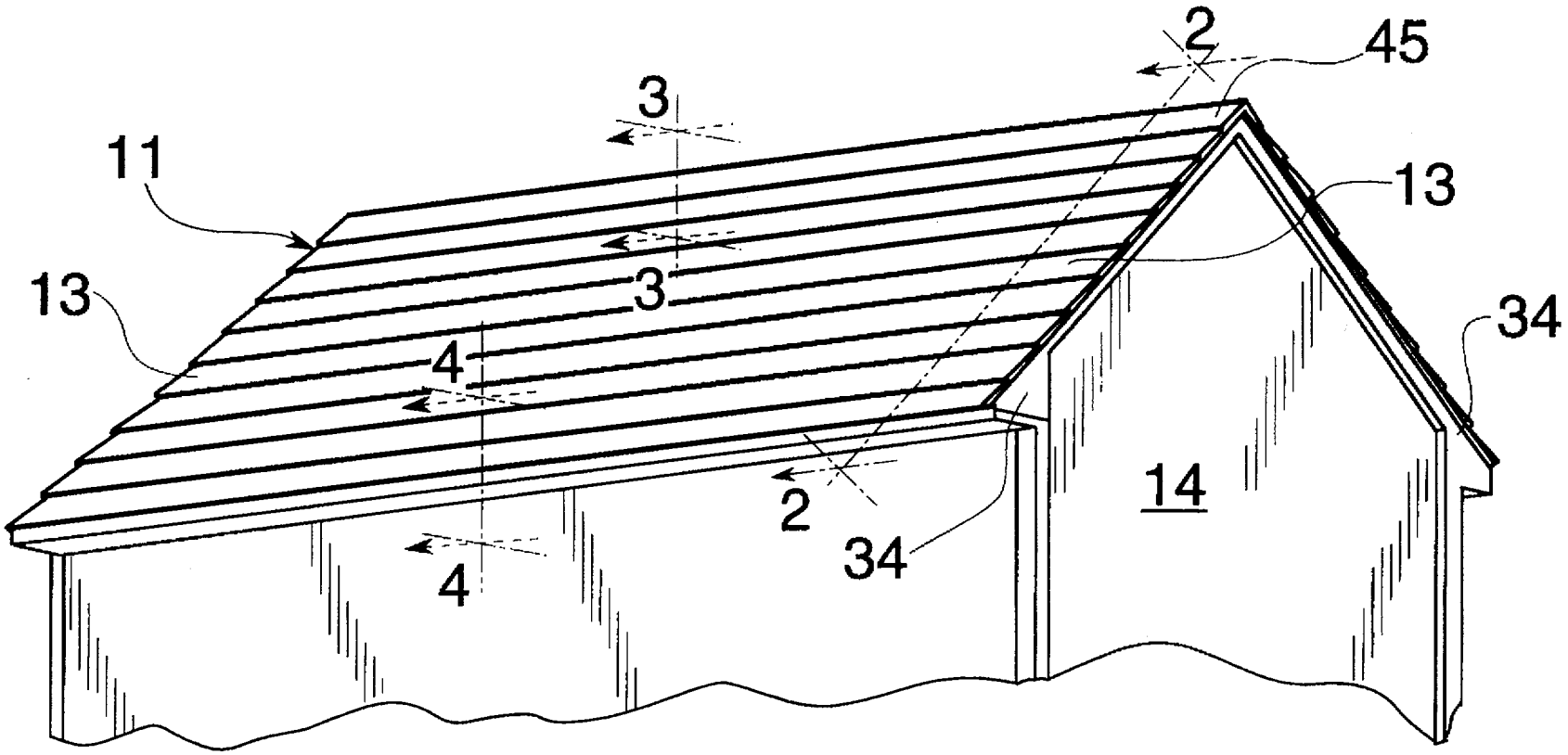
FIG. 1 is a pictorial view of a structure showing a roof in accordance with the invention with continuous tiers extending from side to side on the roof.
Figure 2:
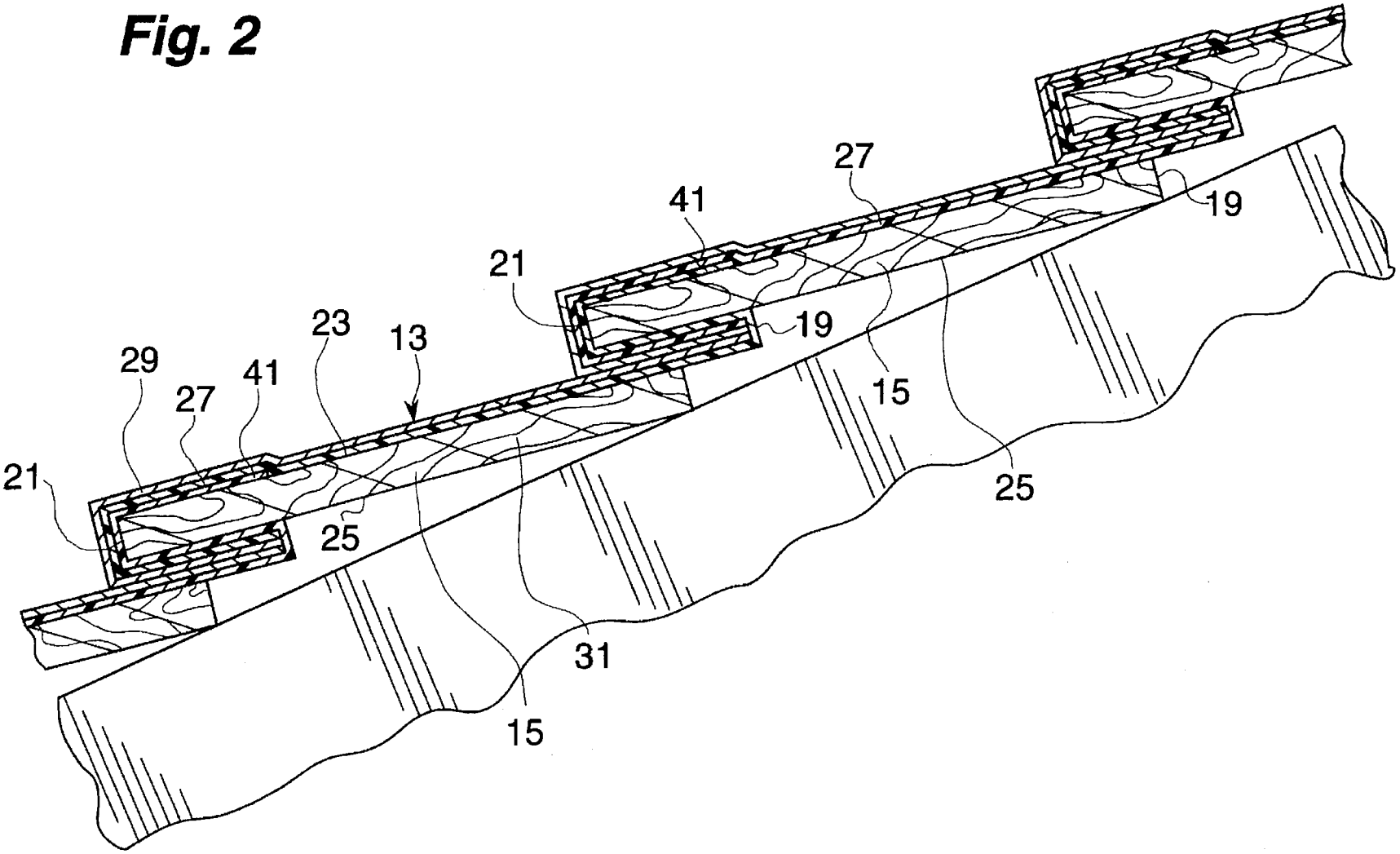
FIG. 2 is a cross-sectional view along line 2—2 of FIG. 1 showing the cross-section of two full tiers and two partial tiers with the wood panels and the plastic strip and the metal cover in place.

Referring now to the drawings, a roof 11 is shown with a series of tiers or rows 13. Each tier or row 13 is continuous, extending horizontally from side 14 to side 14 and with each successive higher tier 13 overlapping the tier 13 beneath it. The roof 11, in accordance with this invention, uses continuous strips of material extending from each side 14 of the roof 11 to the other side 14 without any vertical seam. In order to achieve this, the material is supplied in rolls sized to the desired width. The base material for the tier is wood, most likely plywood, which preferably has a thickness of ½ inch and is cut to a width of sixteen inches. Since wood cannot be rolled, the wood is applied in wood panels 15 cut from sheets and is ultimately affixed end to end horizontally across the roof 11 starting, as is traditional in roofing, at the lower edge 17. The individual wood panels 15 may be secured to one another end to end to form one piece but this is not essential to the invention. Preferably, the wood panels 15 merely abut one another. Each wood panel 15 and each tier 13 of wood panels 15 has an upper edge 19 and a lower edge 21 as well as a face side 23 and an under side 25. The base covering for the wood panels 15 is a strip of plastic 27. The plastic strip 27 must be made from a plastic of high temperature resistance as heat builds up rapidly on a roof when the sun is beating on it during warm or hot weather. The plastic strip 27 needs also to be flexible for ready and easy installation. It serves a a moisture barrier and further seals the wood from damage.

The plastic strip 27 is covered with a metallic cover 29. Copper is a very desirable material for this purpose and weathers to a well- known green color. Such a roof is highly desirable and has a very long life while adding value to the structure on which it is located. However, copper is very expensive and aluminum is a very well regarded substitute. It is possible to obtain aluminum for exterior use that is very weather resistant and aluminum can be obtained in various colors to permit a wide variety of decorative possibilities.

Regardless of the metal used or its color, it is most beneficial that it be provided in a very thin film easily workable, to permit easy application so as readily to form the metal cover 29 over the plastic strip 27 on the wood panels 15.

The plastic strip 27 is first affixed to the wood panels 15 of the initial or first or bottom row or tier 31. At the lower edge 17 of the bottom tier 31, the plastic strip 27 is wrapped under the lower edge 21 of the wood panels 15 and is secured to the wood panels 15 by tacking or stapling or any other appropriate means. Such use of tacks or staples is essential in the bottom tier 31 but in the next and all successive tiers 31, the wood panels 15 pressing down on the next lower successive tier 13 hold the plastic strip 27 and metal cover 29 in place. plastic strip 27 is cut to extend over the wood panels 15 continuously from side 14 to side 14 horizontally. As previously stated, the wood panels preferably have, a width of sixteen inches and a thickness of ½ inch. The plastic strip 27 used preferable has a width such that it will extend the face side 23 of the wood panels about 14½ inches. The metal cover 29 will not extend as far up the wood panels 15 and preferably extend up the wood panels 15 only 10½ inch or 4½ inches less than does the plastic strip 27. Assuming a lap under the wood panels 15 of two inches and ½ inch thickness of the wood, 2½ inches would have to be added to the amount of plastic strip 27 and metal cover 29 that extends up the face side of the wood panels 15 in each tier or row 13. The metal cover 29 would thus be cut 13 inches wide and the plastic strip 27 would be cut 17 inches wide. Each tier 13 has two ends 33 and both the plastic strip 27 and the metal cover 29 preferably are wrapped around the ends 33 of the wood panels 15. However, a face board 34, which may also be metal, is preferably placed over the ends 33 at the sides 14 of the roof 11.

Before the next tier 13 is installed, the wood panels 15 are secured to the rafters 37 of the structure underneath the plastic strip 27, preferably in the central section 39 of the wood panels 15 and as dictated by the location of the rafters of the structure. The plastic strip 27 and the metal cover 29 is held off the wood panels 15 except at the lower edge 17 when the wood panels 15 are affixed. Nails are seemingly the most suitable means of securing the wood panels 15 but any other available means could be used. Once the wood panels 15 are secured in place, the plastic strip 27 and the metal cover 29 are folded over onto the wood panels 15. As previously explained, the plastic strip 27 extends beyond the metal cover 29 thus providing an extended portion 41 of the plastic strip 27. The, extended portion 41, preferably about 4 inches in length, is folded back over the metal cover 29.

Once the bottom tier 31 is in place with the extended portion 41 folded back over its own metal cover 29, the construction of the next successive tier 13 can commence. The wood panels 15 and the plastic strip 27 and the metal cover 29 are the same as used in the bottom tier 31. With the wood panels 15 of the next successive higher tier 13 loosely in place, the extended portion 41 of the next successive lower tier 13 is folded over the lower edge 17 of the next successive higher tier 13 now being installed, such extended portion 41 having previously been folded back over the metal cover 29 of its own tier 13.

With the extended portion 41 in place around the lower edge 17 of the next successive higher tier 13, the plastic strip 27 and metal cover 29 are fitted under the lower edge of the next successive tier 13 being installed. The wood panels 15 are then secured to the structure as has been previously described and the plastic strip 27 and metal cover 29 are wrapped over the wood panels 15 and the procedure is continued until the roof 11 is covered to the peak 43.

Once the peak 43 is reached, a cap 45 must be installed. Two wood members 47 which abut each other are installed on the peak 43 of the roof 11. Each wood member 47 has a bottom edge 49. An L-shaped metal strip is affixed to the bottom edge 49 with one portion of the L-shaped metal strip 51 aligned with the face side 23 of the wood members 47. The wood members 47 are secure to the roof 11 presumably by nailing and a plastic sheet 53 is placed over the wood members 47 and the edges of the plastic sheet 53 is forced under the wood members 47 prior to securing the wood members 47 to the roof 11. Then, a metal member 55 which is formed slightly oversize and with a U-shaped groove 57 at each lower edge 17 which groove 57 fits over the L-shaped metal strip 51. The metal member 55 is flexed open to force the grooves 57 apart sufficiently to fit over the L-shaped metal strip 51 and when the metal member 55 is returned to its unsprung shape, the grooves 57 are over the L-shaped metal strip 51 thereby securing the cap 15 in place. The L-shaped metal strip 51 is affixed to the wood members 47 by cutting tabs 59 from one portion of the L-shaped metal strip 51 and bending them back over in the opposite direction and affixing the tabs 59 to the wood members 47.

The resultant roof 11 is a series of overlapping tiers 13 of wood panels 15 continuously covered with plastic strip 27 and metal cover 29. The metal cover 29 with the plastic strip 27 beneath it extend from under the lower edge 21 of the each tier 13 up a major part of the wood panels 15 in that tier 13 with the plastic strip 27 being wider than the metal cover 29. The plastic strip 27 is folded back over the metal cover 29 and around the lower edge 17 of the next successive tier 13. The next successive tier 13 also has a plastic strip 27 beneath its lower edge 17 and over the extended portion 41 of the plastic strip 27 of the adjacent lower tier 13 with a metal cover 29 extending up the wood panels 15 with the plastic strip 27 folded back over the metal cover 29. The tiers 13 continue as described until the peak 43 of the roof 11 is reached where a cap 45 is located. The cap 45 includes two wood members 47 secured to the structure, each wood member 47 having an L-shaped metal strip 51 along its lower edge 21 and its under side 25. A plastic sheet 53 covers the wood members 47 with its edges under the wood members 47. A metal member 55 is located over the plastic sheet 53, the metal member 55 having U-shaped grooves along its edges which are located on the L-shaped metal strips 51.

Thus, while a preferred embodiment of the invention has been shown and described, it will be apparent to those skilled in the art that many other changes and modifications may be made without departing from the invention in its broader aspects. The appended claims are therefore intended to cover all such changes and modifications as fall within the true spirit and scope of the invention.

I claim:

1. A roof system for covering the roof of a structure, said roof having two sides joined at a peak, said roof system comprising:

a first series of wood panels afixed to a roof of a structure, said first series of wood panels having a face side and an underside and a lower edge and an upper edge, the lower edge being located at the lower edge of a roof of the structure, the first series of wood panels extending from side to side on the roof;

a first continuous plastic strip secured to the underside of the first series of wood panels adjacent the lower edge and wrapped around the lower edge of the first series of wood panels and extending around the lower edge and up the first series of wood panels toward the upper edge of the first series Of wood panels;

a first continuous metal cover wrapped around the lower edge of the first series of wood panels and secured to the under side of the first series of wood panels adjacent the lower edge and extending up the first series of wood panels, the first continuous plastic strip extending up the first series of wood panels toward the upper edge of the first series of wood panels farther than the first metal cover forming a first extended portion, the first extended portion being folded back over the first metal cover;

a second series of wood panels being affixed to the structure, said second series of wood panels having a face side and an under side and a lower edge and an upper edge, the lower edge of the second series of wood panels being located over the upper edge of the first series of wood panels below the upper edge of the first metal cover, the first extended portion being wrapped over the lower edge of the second series of wood panels;

a second continuous plastic strip secured to the underside of the second series of wood panels adjacent the lower edge and wrapped over the first extended portion around the lower edge of the second series of wood panels adjacent the lower edge and up the second series of wood panels toward the upper edge of the second series of wood panels;

a cap located at a peak of the roof of the structure including abutting wood members secured to the structure and covered by a cover plastic sheet and with a cover metal member over the cover plastic sheet, the cap being held in place by lips fitted into grooves in the abutting wood members.

2. A roof system for covering the roof of a structure, said roof having two sides joining at a peak, said roof system comprising:

a first series of wood panels affixed to a roof of a structure and extending from side to side;

a first continuous plastic strip covering the first series of wood panels;

a first continuous metal cover covering the first continuous plastic strip on the first series of wood panels;

a second series of wood panels overlapping the first series of wood panels and over the first plastic strip and first metal cover of the first series of wood panels, the first continuous plastic strip from the first series of wood panels being wrapped about the second series of wood panels;

a second continuous plastic strip covering the second series of wood panels over the first continuous plastic strip wrapped about the second series of wood panels;

a second continuous metal cover covering the second continuous plastic strip on the second series of wood panels.

3. A roof system according to claim 2 further including a cap, said cap including two wood members located at a peak, the wood members being covered with a cover plastic sheet and the cover plastic sheet being covered with a cover metal member.

* * * * *